US009631867B2

(12) United States Patent
Borrel

(10) Patent No.: US 9,631,867 B2
(45) Date of Patent: Apr. 25, 2017

(54) EQUIPMENT AND METHOD FOR PREHEATING A CONTINUOUSLY MOVING STEEL STRIP

(75) Inventor: Pierre-Jerome Borrel, Saint-Chamond (FR)

(73) Assignee: Primetals Technologies France SAS, Savigneux (FR)

( * ) Notice: Subject to any disclaimer, the term of this patent is extended or adjusted under 35 U.S.C. 154(b) by 1206 days.

(21) Appl. No.: 13/516,327

(22) PCT Filed: Mar. 25, 2010

(86) PCT No.: PCT/EP2010/053908

§ 371 (c)(1),
(2), (4) Date: Jun. 26, 2012

(87) PCT Pub. No.: WO2011/072883

PCT Pub. Date: Jun. 23, 2011

(65) Prior Publication Data

US 2012/0264073 A1 Oct. 18, 2012

(30) Foreign Application Priority Data

Dec. 15, 2009 (EP) ..... 09290941

(51) Int. Cl.
*F27D 17/00* (2006.01)
*B05C 9/14* (2006.01)
(Continued)

(52) U.S. Cl.
CPC ..... *F27B 9/28* (2013.01); *C21D 9/56* (2013.01); *C21D 9/561* (2013.01); *C21D 9/562* (2013.01); *F27D 99/0035* (2013.01)

(58) Field of Classification Search
None
See application file for complete search history.

(56) References Cited

U.S. PATENT DOCUMENTS 2,357,126 A * 8/1944 Nachtman ..... C25D 5/50 204/210
2,459,674 A * 1/1949 Nachtman ..... C25D 5/50 204/210
(Continued)

FOREIGN PATENT DOCUMENTS

CN 1369569 A 9/2002
CN 2811921 Y 8/2006
(Continued)

*Primary Examiner* — Gregory Huson
*Assistant Examiner* — Eric Gorman
(74) *Attorney, Agent, or Firm* — Laurence A. Greenberg; Werner H. Stemer; Ralph E. Locher

(57) ABSTRACT

Equipment and a method for preheating a continuously moving steel strip, in particular before feeding the same into a continuous annealing or hot-dip galvanizing furnace, involves the continuous movement of the steel strip in a preheating chamber including a preheating circuit having at least one preheating tube, the inner surface of which is in contact with externally-recovered burnt gases (e.g. from the furnace). A portion of the outer surface of the preheating tube is disposed directly opposite a surface of the strip in order to provide a first preheating mode by irradiating heat onto the strip and the walls of the chamber, and a second preheating mode, mainly by convection, of a gas constituting a controlled atmosphere in the preheating chamber.

23 Claims, 5 Drawing Sheets

(51) Int. Cl.

| | |
|---|---|
| ***F27B 9/28*** | (2006.01) |
| ***F27D 99/00*** | (2010.01) |
| ***C21D 9/56*** | (2006.01) |
| ***F23C 3/00*** | (2006.01) |
| ***C21D 9/00*** | (2006.01) |
| ***F27B 9/00*** | (2006.01) |
| ***C21D 11/00*** | (2006.01) |
| ***F23D 14/12*** | (2006.01) |

(56) References Cited

U.S. PATENT DOCUMENTS 3,468,372 A * 9/1969 Dorsey ..... B21C 37/26 165/180
4,081,296 A * 3/1978 Janatka ..... C21D 9/62 148/526
4,190,416 A * 2/1980 North ..... C03B 19/08 264/43
4,212,635 A * 7/1980 North ..... C03B 19/08 432/121
4,242,154 A * 12/1980 Pilling ..... C21D 9/561 148/533
4,274,825 A * 6/1981 North ..... C03B 19/08 264/43
4,364,728 A * 12/1982 Stamp ..... F27B 9/28 266/102
4,373,702 A * 2/1983 Jayaraman ..... F27B 9/10 266/103
4,398,700 A * 8/1983 Thome ..... C21D 9/573 266/102
4,415,382 A * 11/1983 Gaskey ..... C21D 9/573 148/661
4,494,929 A * 1/1985 Fujioka ..... F27B 9/28 266/102
4,691,898 A * 9/1987 Imose ..... C21D 9/561 266/103
4,760,995 A * 8/1988 Fukuda ..... C21D 9/56 266/103
5,114,770 A * 5/1992 Echizen ..... C23C 16/50 136/258
5,479,808 A * 1/1996 Bricmont ..... F27D 3/026 164/477
5,629,054 A * 5/1997 Kanai ..... C23C 16/511 118/723 MW
5,942,132 A * 8/1999 Toyooka ..... B21C 37/0811 219/61.2
6,096,389 A * 8/2000 Kanai ..... C23C 16/511 118/723 MR
6,238,209 B1 * 5/2001 Iida ..... C21D 9/563 226/190
6,761,778 B2 7/2004 Mignard et al.
8,425,225 B2 * 4/2013 Pasquinet ..... C21D 11/00 148/511
2002/0124916 A1 * 9/2002 Pasquinet ..... C21D 9/573 148/661
2010/0173072 A1 * 7/2010 Borrel ..... C21D 1/76 427/248.1
2010/0213647 A1 * 8/2010 Buchet ..... C21D 1/34 266/44
2012/0325806 A1 * 12/2012 Okada ..... C21D 1/42 219/672

FOREIGN PATENT DOCUMENTS

| | | | |
|---|---|---|---|
| JP | 60135530 | A | 7/1985 |
| JP | 61048533 | A | 3/1986 |
| JP | H10121150 | A | 5/1998 |
| JP | H1161276 | A | 3/1999 |
| JP | 2002206117 | A | 7/2002 |
| JP | 2007321204 | A | 12/2007 |

* cited by examiner

EQUIPMENT AND METHOD FOR PREHEATING A CONTINUOUSLY MOVING STEEL STRIP

BACKGROUND OF THE INVENTION

Field of the Invention

The invention relates to equipment and a method for preheating a continuously moving steel strip, in particular prior to feeding the same into a continuous annealing or hot-dip galvanizing furnace. The equipment includes a preheating circuit formed of at least one preheating tube, the inner surface of which is in contact with externally recovered burnt gases, and the method includes removing burnt gases from the annealing or galvanizing furnace and ducting them into tubes of the preheating equipment.

It is known that, in continuous annealing or galvanizing equipment for continuously moving steel strips, the strip supplied in the form of a coil is first unrolled and then annealed and possibly galvanized before being rewound. It therefore passes rapidly, at a rate which may reach several meters per second, from ambient temperature to a maximum temperature required by the metallurgical objective sought and which may exceed 850° C.

With a view to improving efficiency, numerous efforts have been made to use the energy of the burnt gases in the zones for heating and maintaining the temperature of the furnaces before they are evacuated outside the equipment.

This energy can be recovered in different ways, for example to heat the combustion gases for the direct-flame burners or the radiant tubes of the "recuperator" or "regenerator" types.

It is also possible to recover all or part of this energy to preheat the strip before it is fed into the furnace itself.

Most simply, the burnt gases are collected in the furnace or at the outlet from the radiant tubes and then blown by diffusers on the surface of the strip. In view of the high temperature of the gases, which may reach over 1000° C., they are first diluted in fresh air in order to lower their temperature to values compatible with the operating capacities and the resistance of the exhausters providing for their collection and distribution to the blowing devices on the strip. Typically, the gases are cooled to around 300 to 450° C. before being used for preheating, which harms the efficiency of the operation considerably.

According to another method, described for example in JP 60-135530, the burnt gases pass through an exchanger where they are cooled, giving up some of their heat to a preheating gas blown at the surface of the strip, and then evacuated by evacuation exhausters.

This preheating gas may be air or, as in the case of JP60-135530A, the gas constituting the controlled atmosphere of a radiant tube furnace. Here, the efficiency of the operation is greatly disadvantaged by the efficiency of a supplementary burnt gases/preheating gas exchanger.

Finally, it has also been suggested to feed the burnt gases emerging from the furnace directly into a preheating chamber and circulate them on the surface of the strip using baffles or ducts, said gases thus emerging cooled from the preheating chamber towards the extraction means.

Such an arrangement, described in JP61-048533A, provides for rapid heating but with gases still very hot at the outlet from the preheating chamber, which induces high thermal loads in the evacuation circuits.

Depending on their composition, their temperature, but also the chemical composition of the strip and its temperature, these burnt gases in contact with the strip may also be found to be unsuited to obtaining certain surface oxidation-reduction conditions for the strip.

The invention must therefore make it possible to resolve these problems, in particular making it possible to preheat the strip in a chamber with a controlled atmosphere, to recover in exhausters eventually very cool preheating gases which require no dilution. The invention must make it possible to avoid the need for an external exchanger between a hot gas and the actual preheating gas and provides for the reconstitution of greatly cooled gases the evacuation of which is thus made considerably easier.

BRIEF SUMMARY OF THE INVENTION

The invention thus proposes associated preheating equipment comprising at least one external radiant fin of the outer surface of the preheating tube disposed directly opposite a surface of the strip in order to provide a first preheating mode by thermal radiation onto the strip and the walls of the chamber, as well as a second preheating mode, mainly by convection, of a gas constituting a controlled atmosphere in the preheating chamber. The method comprises causing the burnt gases to give up part of their thermal energy to the preheating tubes through contact with their inner walls and transferring part of this thermal energy by conduction to the outer surface of the preheating tubes, which provides for heating of the strip by radiation and heating of the gas and the walls of the preheating chamber by convection and radiation. A set of sub-claims covers the various aspects and advantages.

The invention relates to equipment capable of preheating a continuously moving steel strip before it is fed into a continuous annealing or galvanizing furnace wherein burnt gases externally recovered in direct flame burners or radiant tubes used for heating or maintaining the temperature of said strip in the furnace are withdrawn and then ducted into at least one strip preheating unit, itself included in a preheating chamber under a controlled atmosphere, and then these gases, now cooled, are extracted from the preheating chamber and ducted towards an evacuation device, for example an exhauster and a chimney.

In principle, the preheating equipment for a continuously moving steel strip in a preheating chamber includes (in said chamber) a preheating circuit made up of at least one preheating tube the internal surface of which is in contact with externally recovered burnt gases. This aspect may be close to JP60135530A, which presents real tubes of an exchanger additional to the preheating module, and to JP61048533A which includes vessels similar to tubes where burnt gases are injected. According to the present invention, the preheating equipment differs from each of these documents in that a part of the outer surface of said preheating tube is placed at a certain distance and directly opposite a surface of the strip, providing for, on the one hand, a first preheating mode by thermal radiation onto the strip and the walls of the chamber and, on the other hand, a second preheating mode, mainly by convection, of a gas constituting a controlled atmosphere in the preheating chamber, said gas being at least present between the outer surface of the tube and the surface of the strip. The distance separating the outer surface of the tube and the surface of the strip can be adjusted depending on the intensity of the effects of the two modes to be provided, which thus makes it possible to weight them together and separately and thus better to control the efficiency of the desired preheating. In this respect, even if a priori this distance is free from any obstacle obstructing a direct view between the outer surface of the tube and a surface of the strip, it may be envisaged that elements or screens with apertures are put in position, the materials of which have properties influencing at least one of the two said modes.

The additional gas under controlled atmosphere has predetermined oxidation-reduction properties depending on the strip and any other material coming into direct contact with it. Thus, the strip is advantageously not altered chemically. In the chamber, the additional gas may be static or in circulation outside the tube directly next to the strip, i.e. between part of the outer surface of the tube and the surface of the strip. Finally, the equipment advantageously provides that the burnt gases fed into the preheating chamber do not mix with the controlled atmosphere of the furnace, unlike JP361048533A.

The above mentioned preheating unit is thus made up of at least one preheating tube the inner surface of which is in contact with the burnt gases and the outer surface of which is partly directly opposite the surface of the strip, said tube concomitantly providing for the following, while advantageously leaving the strip free from any (altering) contact with the burnt gases:

Heating of the strip by radiation.

Heating of the gas and the walls of the preheating chamber by convection and radiation.

Preheating tube is taken to mean any body having an inner wall and an outer wall and having apertures at two of its ends, an inlet aperture for burnt gases and an outlet aperture.

The outer surface of a tube installed in a preheating chamber is partly directly opposite the surface of the strip and partly also directly opposite the walls of the chamber which, in their turn, are capable of radiating onto the surface of the strip and heating the chamber gas by convection.

The preheating equipment is capable of being positioned prior to feeding said strip in a continuous annealing or galvanizing furnace wherein the burnt gases are recovered in direct flame burners or radiant tubes used for heating or maintaining the temperature of said strip in the furnace and including:

Ducting of said gases from the furnace to the strip preheating unit included in the preheating chamber under a controlled atmosphere.

An evacuation device to extract the gases from the preheating chamber, for example in the form of an exhauster and a chimney.

In principle, any recoverable source of burnt gases such as are readily available in metal strip processing furnaces can be connected to a tube inlet on the preheating equipment according to the invention. It is thus possible to make energy savings and considerable environmental progress.

A plurality of preheating tubes may thus be arranged side by side, for example perpendicular to the direction of movement of the strip, in layers substantially parallel to it and directly opposite at least one of its faces. These layers are thus in a situation of direct radiation onto the surface of the strip in order to provide for effective and homogenous heating thereof.

According to a preferred embodiment, these layers therefore have the advantage of being placed as close as possible to the strip while guaranteeing the absence of contact with it during its movement, taking account of its deformations and movements. The above mentioned elements or screens can be placed next to said layers while guaranteeing at least one space free of contact with the strip.

The heating equipment may be designed so that the strip undergoes a vertical movement in at least one pass between rollers situated below and above the chamber and that at least one layer of (horizontal) preheating tubes is directly opposite a face of each rising or falling pass of the strip.

In order to provide for better heating, at least two layers of preheating tubes, each directly opposite one of the two faces of the strip, concomitantly provide for the heating of the two faces of each rising or falling strip pass.

According to an advantageous design, the layers of preheating tubes are made up of a plurality of tubes connected together by manifolds which can be integrated with the adjacent ends of the tubes.

The preheating equipment includes in particular at least one fixing unit capable of holding at least one tube or at least one layer of preheating tubes and advantageously makes it possible to adjust the heating properties, depending on the characteristics of the strips, their formats (width, thicknesses), rate of movement, etc, and facilitates support for each tube. In particular, said preheating equipment includes detachment means coupled to said fixing unit and means for isolating each layer of tubes, thus detachable, advantageously making it respectively possible individually to remove each layer of tubes mounted on said fixing unit and individually to isolate (in particular on the fumes side) each layer of tubes from the other layers of tubes. Thus, the layers can be supported in the chamber by said fixing units, which may advantageously be compatible with those of radiant tubes with which the layers are thus interchangeable. This arrangement makes it possible to use assembly and dismantling tools identical to those used for a furnace with radiant tubes. It also makes it possible to mount a radiant tube temporarily in the event of removal of a layer for repair.

Advantageously, in the event of a problem associated with the preheating equipment, such as for example in the event of a holed tube, unlike with external exchangers made up of a bundle of tubes in one chamber and requiring dismantling of all of the tubes (20 to 60 tubes) belonging to said bundle when one of the tubes is holed, the fixing unit in the present invention makes it possible simply to remove the layer to which said holed tube belongs or to isolate said layer with respect to the other layers using said isolation means, awaiting, for example, the next stoppage for maintenance of the preheating equipment. Also, detachment and isolation means advantageously provide for simple and effective adaptation of the preheating equipment to an increase in the power of the furnace, for example by replacing a layer with four recovery tubes with a radiant gas tube, which would not save more energy, but would provide for an increase in production. Thus, the fixing unit and said detachment and isolation means provide in particular for an adaptation of the geometry of the layers of tubes to the strip heating conditions.

In order to maximize the radiating surface area of the layers of preheating tubes, the latter may be positioned so that, at operating temperature, (as a result of expansion due to thermal effects) they are as appropriately close as possible to one another, in particular in that at least two preheating tubes are positioned so that an interstice between them is between zero and 1/40 of the distance of said tubes from the strip.

In a design variant, the preheating tubes are positioned so that, at operating temperature, (as a result of expansion due to thermal effects), an interstice is definitely arranged between two successive tubes, the ratio between the tubes/strip distance and the width of the interstice being between 4 and 40 so as to ensure preheating effectively suited to a steel strip.

In this configuration, it is advantageous to implement forced circulation of the chamber gas (additional gas under a controlled atmosphere) between at least one recovery point and at least one space situated between adjacent banks of preheating tubes directly opposite one another. This circulation, provided in particular by means of a blowing device, makes it possible to improve exchanges by convection.

It also makes it possible, through the interstices positioned between successive tubes, to blow the heated gases between adjacent preheating banks directly opposite one another orthogonally or with a slight inclination over the surface of the strip. For this purpose, the blowing device is in particular capable of producing at least one jet of said heated gases between adjacent preheating banks.

It is then advantageous to maintain a ratio between the spacing of successive tubes in the layer and the tubes/strip distance of between 1 and 5. The spacing of successive tubes is in particular equal to the distance separating the central longitudinal axes of two successive tubes. In fact, if the tubes are too close together (ratio <1), successive jets disturb one another and, if they are too far apart (ratio >5), the space situated between adjacent banks of preheating tubes will be the site of few thermal exchanges.

It may also be advantageous to implement circulation not between a collection point and a space situated between adjacent banks of preheating tubes directly opposite one another, but by collecting the chamber gas between said banks with a view to heating it and blowing it through blowing buses over the surface of the strip counter to its direction of movement.

The preheating tubes constituting the preheating unit may be fitted with at least one internal recovery fin in contact with the burnt gases. These recover heat by contact with the burnt gases and by radiation from the internal walls of the tube.

The preheating tubes can also be fitted with at least one external radiant fin in contact with the chamber gas and capable of radiating over the strip.

These provisions make it possible considerably to improve the performance of thermal exchange by convection and radiation with the strip, the gases and the chamber walls.

In the case of a furnace with at least one direct flame heating zone, the burnt gas recovery manifolds may advantageously be situated inside the furnace chamber, without emerging into free air, before being ducted towards the preheating chamber. Within the preheating chamber, the manifolds feeding preheating units may also remain situated inside said chamber, which avoids any energy losses and costly heat insulation.

In the case of a radiant tube furnace, the preheating chamber may advantageously be in direct communication with the furnace chamber and share the same controlled atmosphere. In this case, the burnt gases are recovered traditionally at the outlet from the radiant tubes outside the furnace chamber.

The invention also relates to a method for preheating a continuously moving steel strip prior to feeding same into a continuous annealing or galvanizing furnace wherein the burnt gases are removed from said annealing or galvanizing furnace, ducted into tubes of the preheating equipment according to one of the preceding claims, i.e. ducted into at least one strip preheating unit, itself included in a preheating chamber under controlled atmosphere, and then extracted from the preheating chamber by a cooled gas exhauster.

Said method is characterized in that the preheating unit is made up of at least one preheating tube with an inner wall in contact with the burnt gases and an outer wall in a situation of direct radiation over the surface of the strip and that:

- The burnt gases give up part of their thermal energy to the preheating tubes through contact with their inner walls.
- This thermal energy is transferred by conduction to the outer surface of the preheating tubes, which provides for:
  - Heating of the strip by radiation.
  - Heating of the gas and the walls of the preheating chamber by convection and radiation.

Advantageously, the method implements preheating tubes constituting a preheating unit each having at least one internal recovery fin and at least one external radiant fin and that:

- The burnt gases give up part of their thermal energy to the preheating tubes through contact with their inner walls and with their internal recovery fins.
- Part of this thermal energy is transferred by conduction to the outer surface of the preheating tubes and their external radiant fins, which provides for:
- Heating of the strip by radiation.
- Heating of the gas and the walls of the preheating chamber by convection and radiation.
- Another part of the thermal energy given up to the preheating tubes through contact between the burnt gases and their inner walls and their internal recovery fins is exchanged through radiation between said inner walls of the preheating tubes and said internal recovery fins.

In a variant of the method, the preheating chamber gas is put into forced circulation between at least one recovery point and at least one space situated between adjacent preheating banks directly opposite one another, from which this heated gas is blown orthogonally over the surface of the strip through the interstices arranged between the preheating tubes or their external radiant fins.

In another variant of the method, the preheating chamber gas is put into circulation not between a collection point and a space situated between adjacent preheating banks directly opposite one another, but is collected between said banks with a view to being recirculated by blowing over the surface of the strip counter to its direction of movement.

DESCRIPTION OF THE INVENTION

Figure 1:
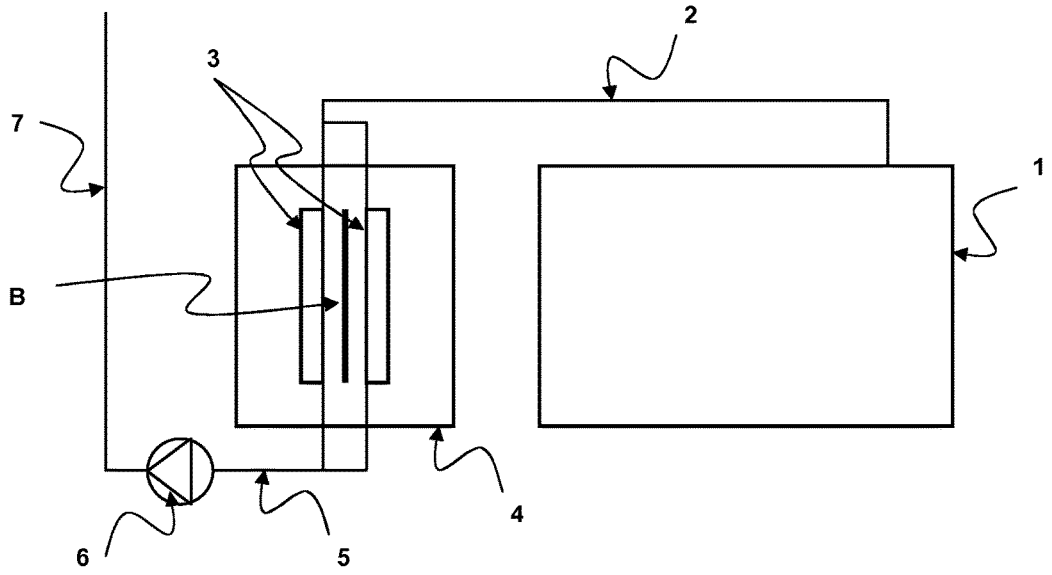
FIGS. 1 to 6 provide a better understanding of the invention.

FIG. 1 describes the general principle of the preheating equipment according to the invention: burnt gases are taken from a furnace (1) by means of collection ducts (2). These ducts feed preheating units (3) for a moving strip (B) in an insulated preheating chamber (4) under a neutral gas atmosphere (=additional gas, distinct from the burnt gases). Extraction ducts (5) recover the cooled burnt gases after they have passed into the preheating units (3) and an exhauster (6) ducts said gases towards an evacuation circuit (7) outside the preheating units.

Figure 2:
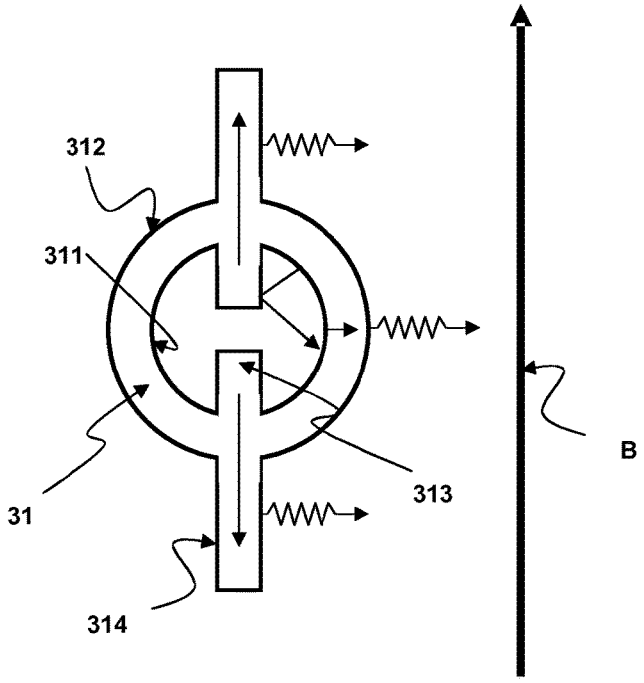

FIG. 2 describes the principle of preheating a strip (B) by means of a preheating tube (31) in a preheating unit or circuit (3). When tubes (31) are mentioned in the following description, it refers to a plurality of tubes each being designated with reference numeral 31. The burnt gases emerging from a continuous annealing or galvanizing furnace circulate inside each of the preheating tubes, which include an inner wall (311) in contact with the hot gases and an outer wall (312) situated in the immediate proximity of the strip. On this figure, the tube presents, as an example, a circular cross-section and has two internal recovery fins (313) and two external radiant fins (314).

The burnt gases give up part of their heat to the preheating tubes (31) through contact with their inner walls (311) and with their internal recovery fins (313). Most of this heat is transferred by conduction to the outer wall (312) and to the external radiant fins (314) which provide both for heating the strip (B) and the chamber walls by radiation, and heating the neutral gas in said chamber by convection. Part of this heat is exchanged by radiation between the inner wall (311) and the internal recovery fins (313).

Figure 3:
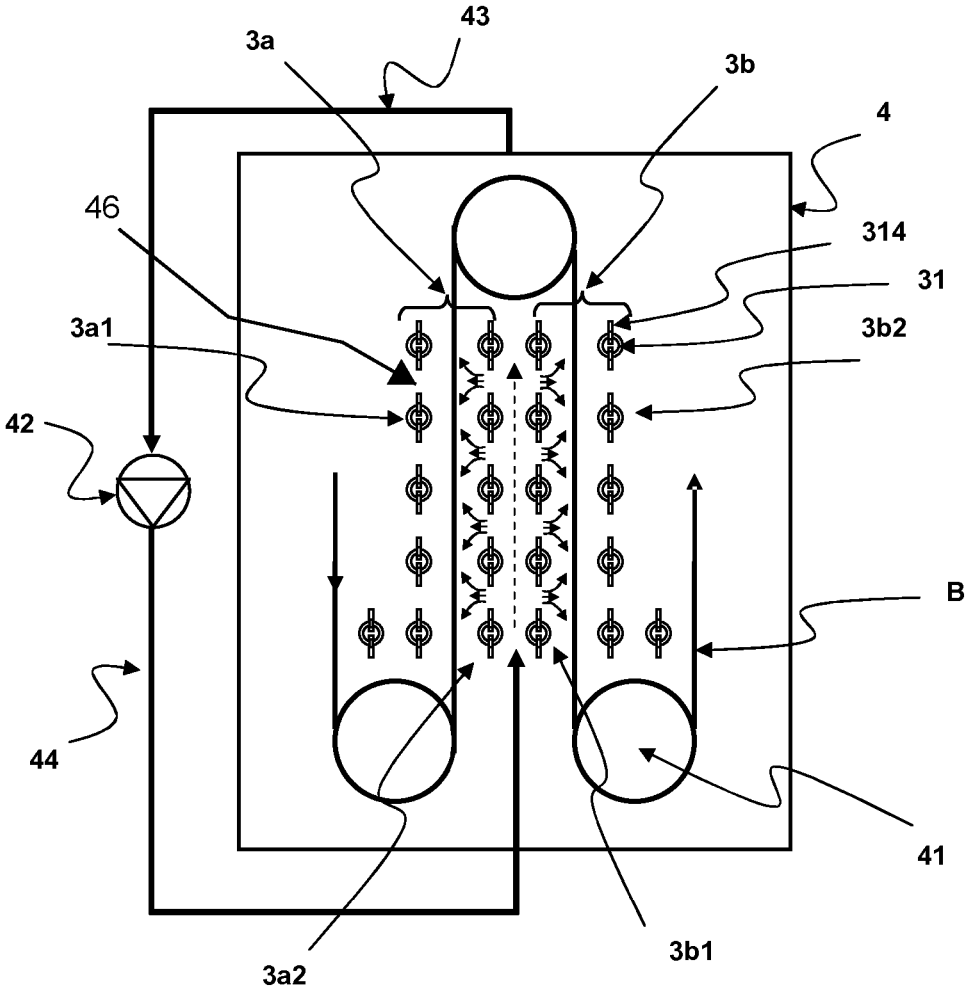

FIG. 3 describes an example of an arrangement of two preheating units (3*a*, 3*b*). Each heating unit has two layers made up of a plurality of tubes (31), here, as an example, tubes with fins, each of the layers being positioned as close as possible to each of the two faces of the strip, which moves on rollers (41) in at least two vertical passes. Each preheating unit thus provides for the heating of a rising pass (for 3*a*) or a falling pass (for 3*b*) of the strip (B) moving in the preheating chamber (4).

In this example, therefore, the following are found successively in the direction of progression of the strip:

- A first layer (3*a*1) belonging to a first preheating unit (3*a*) with one of its faces turned towards the strip.
- A rising pass of the strip.
- A second layer (3*a*2) belonging to the first preheating unit (3*a*) with one of its faces turned towards the strip.
- A third layer (3*b*1) belonging to a second preheating unit (3*b*) adjacent to the first unit (3*a*) with one of its faces turned towards the strip.
- A falling pass of the strip.
- A fourth layer (3*b*2) belonging to the second preheating unit (3*b*) with one of its faces turned towards the strip.

Between layers (3*a*1) and (3*a*2) and also between layers (3*b*1) and (3*b*2), the moving strip is subjected respectively to radiation from the two preheating units (3*a*-3*b*).

Between layers (3*a*2) and (3*b*1), a volume of neutral gas is subjected to heating by the adjacent faces of the first and second preheating units.

In this example of FIG. 3, the preheating tubes are positioned so that an interstice 46 of a size between ¼ and 1/40 of their distance from the strip is placed between their respective external radiant fins and an exhauster (42) provides for forced circulation of the neutral gas between an extraction duct (43) and a blowing duct (44) feeding the space situated between layers (3*a*2-3*b*1) of the two adjacent preheating units (3*a*-3*b*). The gas is heated by convection between these two layers and is blown over the surface of the strip through the interstices placed between the radiant fins (314). The blowing duct (44) can be split into as many branches as necessary to ensure that the neutral gas is blown into as many spaces situated between the set of adjacent preheating units as are included in the preheating chamber.

In order further to increase the exchanges by convection and radiation with the strip, the walls and the chamber gas, one or more layers may be added between the layers represented in FIG. 3.

Figure 4:
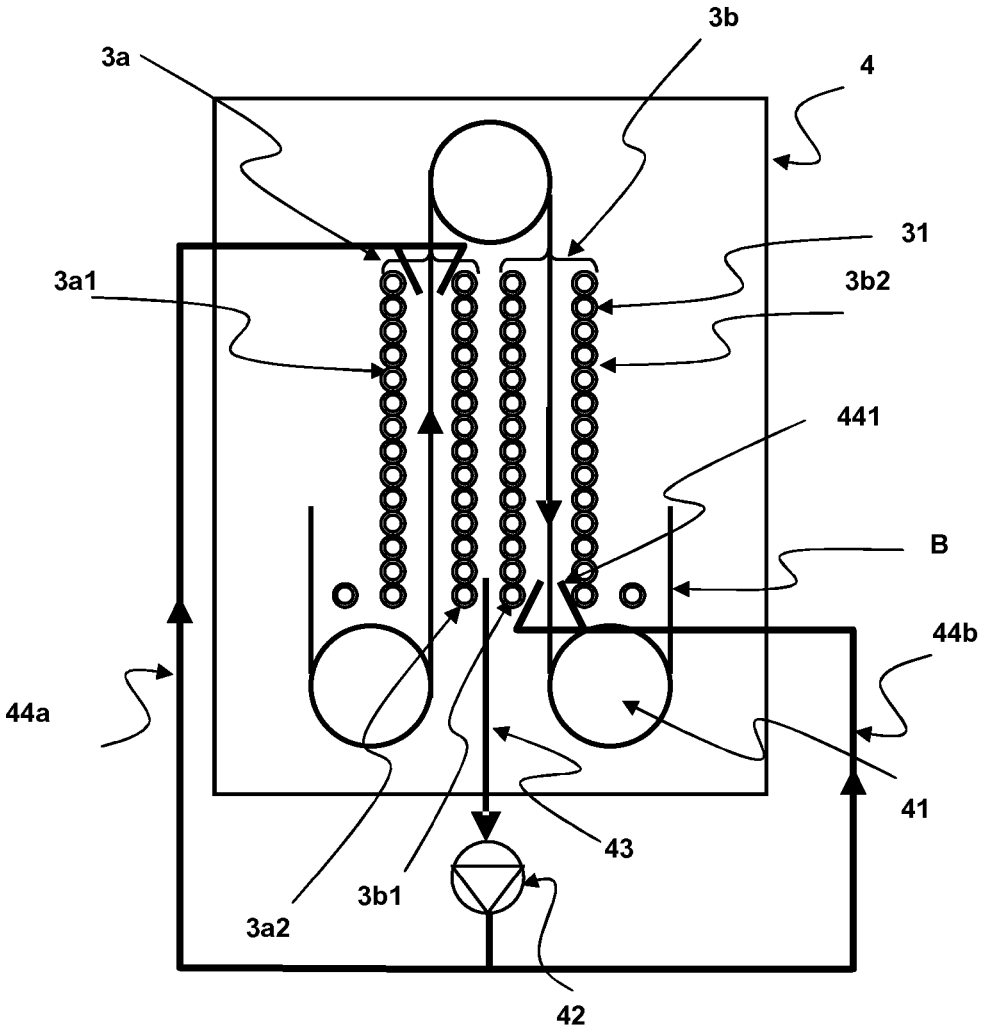

FIG. 4 describes another example of an arrangement of two preheating units (3*a*, 3*b*). Each heating unit has two layers made up of a plurality of tubes (31), each of the layers being positioned as close as possible to each of the two faces of the strip, which moves on rollers (41) in at least two vertical passes. Each preheating unit thus provides for the heating of a rising pass (for 3*a*) or a falling pass (for 3*b*) of the strip (B) moving in the preheating chamber (4).

In this example, therefore, the following are found successively in the direction of progression of the strip:

- A first layer (3*a*1) belonging to a first preheating unit (3*a*) with one of its faces turned towards the strip.
- A rising pass of the strip.
- A second layer (3*a*2) belonging to the first preheating unit (3*a*) with one of its faces turned towards the strip.
- A third layer (3*b*1) belonging to a second preheating unit (3*b*) adjacent to the first unit (3*a*) with one of its faces turned towards the strip.
- A falling pass of the strip.
- A fourth layer (3*b*2) belonging to the second preheating unit (3*b*) with one of its faces turned towards the strip.

Between layers (3*a*1) and (3*a*2) and also between layers (3*b*1) and (3*b*2), the moving strip is subjected respectively to radiation from the two preheating units (3*a*-3*b*).

Between layers (3*a*2) and (3*b*1), a volume of neutral gas is subjected to heating by the adjacent faces of the first and second preheating units.

In this example of FIG. 4, the preheating tubes are positioned so that there is no notable interstice between them. An exhauster (42) provides for forced circulation of the neutral gas between an extraction duct (43) and two blowing ducts (44*a*-44*b*) feeding blowing buses (441) blowing the heated neutral gas over the surface of the strip with an almost tangent incidence and in a direction opposite to its direction of movement. The extraction duct (43) collects the heated neutral gas between layers (3*a*2) and (3*b*1). The blowing duct (44) can be split into as many branches as necessary to ensure that the neutral gas is blown into as many rising or falling passes of the strip as are included in the preheating chamber.

In order further to increase the exchanges by convection and radiation with the strip, the walls and the chamber gas, one or more layers may be added between the layers represented in FIG. 4.

Figure 5:
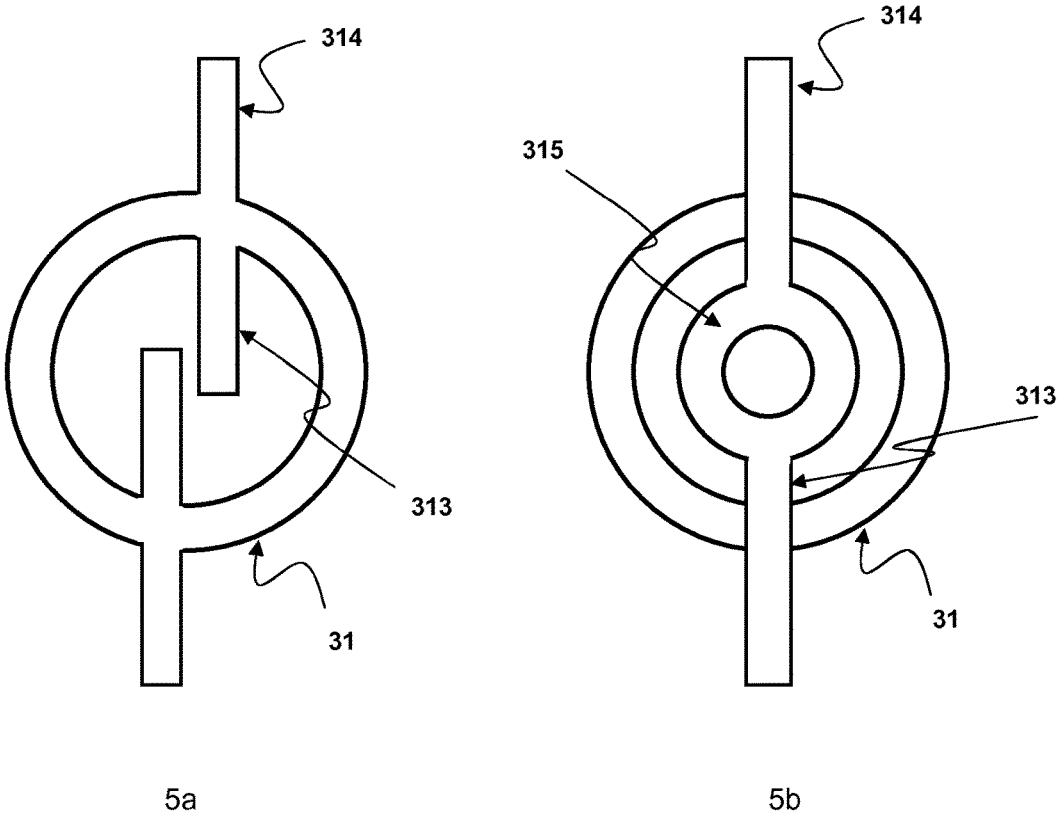

FIG. 5 describes two design examples for preheating tubes (31). In 5*a*, the length of the internal recovery fins (313) has been increased in order to improve the exchange with the burnt gases circulating inside the tube. In 5*b*, the addition of a tube (315) concentric with tube (31) also improves the exchange with the burnt gases and, at an identical flow rate, increases their speed of circulation.

Figure 6:
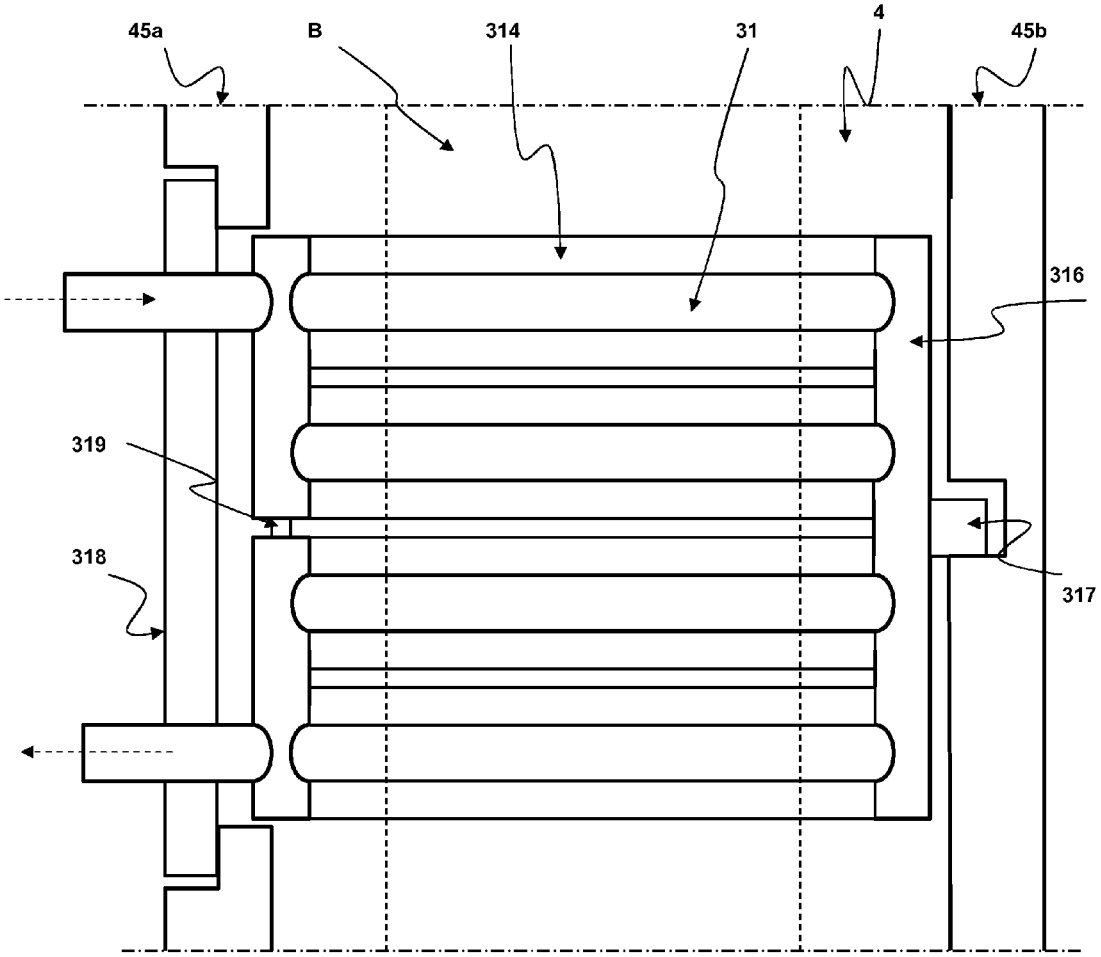

FIG. 6 describes an option for modular design of the layers of preheating tubes, facilitating replacement of them. The number of tubes constituting a layer element may vary depending on needs and the example of the figure representing four tubes is not restrictive. Each layer element is made up of a plurality of tubes (31), each being fitted with two fins (314). The burnt gases circulate between an inlet and an outlet inside the tubes (31) connected together by manifolds (316). The layer is supported by a fixing plate (318) detachably fixed to the wall (45*a*) of the chamber (4) and by at least one lug (317) resting on the other wall (45*b*). Support bodies (319) integrating the different elements make it possible to give the layer the rigidity needed for usage and handling. Such an arrangement can be implemented with tubes with or without fins as represented in the figure.

This arrangement provides for total interchangeability of the layers of heating tubes with traditional radiant tubes fitted with burners. Thus, the method according to the invention can substitute economically for preheating using radiant tubes on existing equipment.

With respect to the prior art, the invention has numerous advantages:

No need to use exchangers external to the equipment.

No need to dilute the burnt gases prior to feeding into the heating circuits.

Heating by convection with no direct contact between the strip and the burnt gases.

Great strip heating effect by radiation.

Very simple structure of the equipment, based on tubes with fins, the manufacture of which is easy and can easily be automated.

Flexibility of arrangement of the tube positions, distance between tubes and between tube and surface of the strip by means of a simple base plate.

Layers of heating tubes easily interchangeable from outside the preheating chamber. Tubes may be detachable. Easy inter-tube or inter-layer nesting of manifolds.

Layers of heating tubes interchangeable with radiant tubes.

Greatly cooled gases evacuated, not requiring exhausters capable of withstanding high temperatures (advantage identical to equipment with external exchanger but without the drawbacks).

The invention claimed is:

1. Equipment for preheating a continuously moving steel strip, the equipment comprising:

a preheating chamber for the steel strip, said preheating chamber including walls and a preheating circuit having at least one preheating tube; and said at least one preheating tube having an inner surface in contact with externally recovered burnt gases and an outer surface with at least one external radiant fin configured to be disposed directly opposite a surface of the strip, to provide a first preheating mode by thermal radiation onto the strip and said walls of said preheating chamber and a second preheating mode, mainly by convection, of a gas constituting a controlled atmosphere in said preheating chamber, wherein there is no direct contact between the strip and the burnt gases.

2. The preheating equipment according to claim 1, which further comprises:

a continuous annealing or galvanizing furnace for heating or maintaining a temperature of the strip in the furnace;

ducting conveying burnt gases recovered from said furnace to said preheating circuit in said preheating chamber under a controlled atmosphere; and an evacuation device for extracting the gases from said preheating chamber.

3. The preheating equipment according to claim 2, wherein said evacuation device includes an exhauster.

4. The preheating equipment according to claim 1, wherein said at least one preheating tube includes a plurality of preheating tubes disposed side by side and forming at least one layer substantially parallel to the strip and directly opposite at least one of the faces of the strip.

5. The preheating equipment according to claim 1, which further comprises:

rollers disposed above and below said preheating chamber and configured to impart a vertical movement to the strip in at least one pass between said rollers;

said at least one preheating tube including at least one layer of preheating tubes directly opposite a face of each rising or falling pass of the strip.

6. The preheating equipment according to claim 4, wherein said at least one layer of preheating tubes includes at least two layers of preheating tubes each disposed directly opposite a respective one of two faces of the strip and configured to concomitantly provide for heating the two faces of each rising or falling pass of the strip.

7. The preheating equipment according to claim 4, wherein said layers of preheating tubes include a plurality of preheating tubes having adjacent ends, and manifolds are configured to be integrated with said adjacent ends for interconnecting said preheating tubes.

8. The preheating equipment according to claim 2, wherein:

said at least one preheating tube includes a plurality of preheating tubes disposed side by side and forming layers; and bodies support each of said layers of preheating tubes in said preheating chamber.

9. The preheating equipment according to claim 1, wherein said at least one preheating tube includes at least two preheating tubes positioned with between a zero interstice therebetween and an interstice therebetween of 1/40 of a distance between said preheating tubes and the strip.

10. The preheating equipment according to claim 1, wherein said at least one preheating tube includes at least two preheating tubes positioned with an interstice between two successive preheating tubes having an interstice width, and a ratio between a distance between said preheating tubes and the strip and said interstice width is between 4 and 40.

11. The preheating equipment according to claim 10, wherein said at least two preheating tubes are disposed successively and form layers, said successively disposed preheating tubes have a spacing therebetween, and a ratio of said spacing in said layers and said distance between said preheating tubes and the strip is between 1 and 5.

12. The preheating equipment according to claim 10, wherein the gas in said preheating chamber is forced to circulate between at least one recovery point in said preheating chamber and at least one space situated between adjacent groups of preheating tubes directly opposite one another.

13. The preheating equipment according to claim 10, wherein the gas in said preheating chamber is heated between adjacent groups of preheating tubes directly opposite one another and blown orthogonally over the surface of the strip through interstices between successive preheating tubes.

14. The preheating equipment according to claim 1, wherein said at least one preheating tube includes a plurality of preheating tubes in adjacent groups, and the gas in said preheating chamber is forced to circulate between at least two of said adjacent groups of said preheating tubes directly opposite one another and at least one point at which the gas is blowing over the surface of the strip.

15. The preheating equipment according to claim 14, wherein the gas in said preheating chamber is blown over the surface of the strip counter to a direction of movement of the strip.

16. The preheating equipment according to claim 15, wherein the gas is blown through blowing buses.

17. The preheating equipment according to claim 1, wherein each said at least one preheating tube is fitted with at least one respective internal recovery fin.

18. The preheating equipment according to claim 1, further comprising a plurality of preheating tubes, each of said plurality of preheating tubes being fitted with said at least one external radiant fin.

19. The preheating equipment according to claim 1, wherein said at least two preheating tubes form layers.

20. A method for preheating a continuously moving steel strip, the method comprising the following steps:

removing burnt gases having thermal energy from an annealing or galvanizing furnace;

ducting the burnt gases into preheating tubes in the preheating chamber of the preheating equipment according to claim 1 for preheating the steel strip prior to feeding the steel strip into the furnace;

giving up part of the thermal energy of the burnt gases to the preheating tubes through contact with inner walls of the preheating tubes; and transferring part of the thermal energy of the burnt gases by conduction to an outer surface of the preheating tubes for:

heating the strip by radiation and heating the gas and walls of the preheating chamber by convection and radiation.

21. The preheating method according to claim 20, which further comprises:

fitting each of the preheating tubes of a preheating unit with at least one internal recovery fin and at least one external radiant fin;

giving up part of the thermal energy of the burnt gases to the preheating tubes with the internal recovery fins as well as through the contact with the inner walls;

transferring part of the thermal energy through the external radiant fins as well as by the conduction to the outer surface of the preheating tubes for:

heating the strip by radiation and heating the gas and the walls of the preheating chamber by convection and radiation; and exchanging another part of the thermal energy given up to the preheating tubes through contact between the burnt gases and the inner walls and the internal recovery fins through radiation between the inner walls of the preheating tubes and the internal recovery fins.

22. The preheating method according to claim 20, which further comprises:

forcing circulation of the gas in the preheating chamber between at least one recovery point and at least one space situated between adjacent groups of the preheating tubes disposed opposite one another; and blowing the heated gas orthogonally over the surface of the strip through interstices disposed between the preheating tubes or the external radiant fins.

23. The preheating method according to claim 20, which further comprises circulating the gas in the preheating chamber between adjacent groups of the preheating tubes disposed opposite one another and buses blowing the gas over the surface of the strip counter to a direction of movement of the strip.

* * * * *